United States Patent [19]

Theurer

[11] 4,066,020

[45] Jan. 3, 1978

[54] MOBILE TRACK TAMPING AND TRACK POSITION CORRECTION MACHINE

[75] Inventor: Josef Theurer, Vienna, Austria

[73] Assignee: Franz Plasser Bahnbaumaschinen-Industriegesellschaft m.b.H., Vienna, Austria

[21] Appl. No.: 695,734

[22] Filed: June 14, 1976

[30] Foreign Application Priority Data

Feb. 20, 1976 Austria ..... 1237/76

[51] Int. Cl.[2] ..... E01B 27/17

[52] U.S. Cl. ..... 104/7 B; 104/12

[58] Field of Search ..... 104/2, 7 R, 7 B, 8, 104/10, 12

[56] References Cited

U.S. PATENT DOCUMENTS

| | | | |
|---|---|---|---|
| 3,486,461 | 12/1969 | Plasser et al. | 104/7 R X |
| 3,504,634 | 4/1970 | Plasser et al. | 104/8 |
| 3,675,581 | 7/1972 | Plasser et al. | 104/12 |
| 3,795,198 | 3/1974 | Plasser et al. | 104/8 X |

FOREIGN PATENT DOCUMENTS

| | | | |
|---|---|---|---|
| 662,481 | 5/1963 | Canada | 104/10 |

*Primary Examiner*—Robert J. Spar
*Assistant Examiner*—Randolph A. Reese
*Attorney, Agent, or Firm*—Kurt Kelman

[57] ABSTRACT

A mobile track tamping and leveling machine comprises an elongated carrier beam centered between the track rails and mounted on two undercarriages for mobility on the track. A pair of tamping heads is mounted transversely symmetrically on the carrier beam for vertical movement thereon, each tamping head being mounted laterally of the carrier beam and astride a respective one of the rails. Each tamping head comprises a carrier supporting tamping tools capable of tamping ballast under the ties and drive means for vibrating and reciprocating the tamping tools in the direction of track elongation.

20 Claims, 6 Drawing Figures

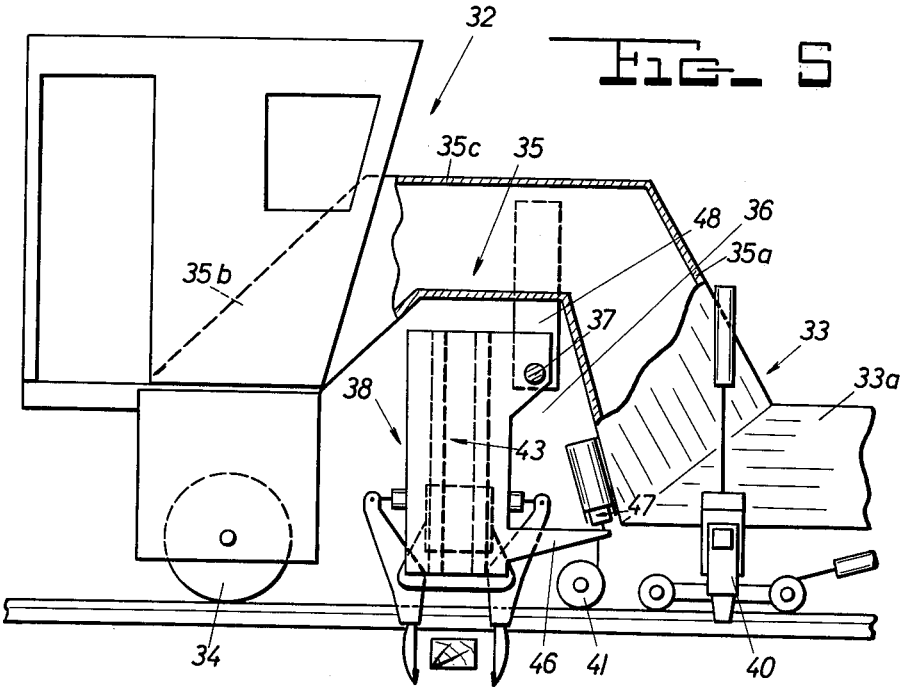
FIG. 5
FIG. 6
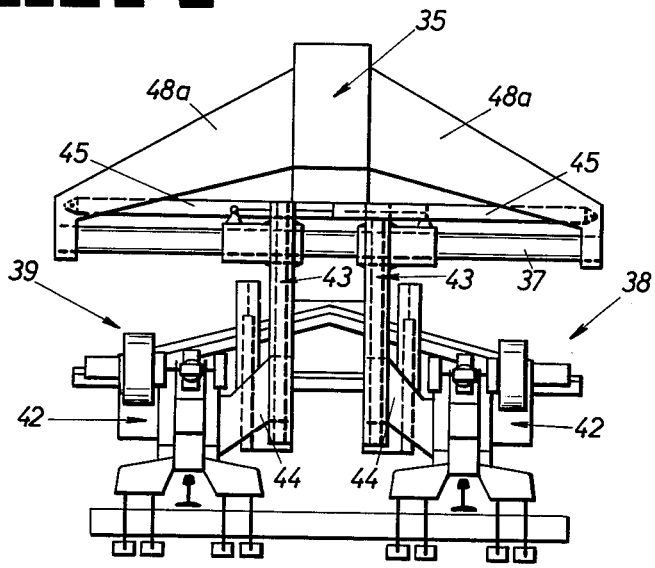

MOBILE TRACK TAMPING AND TRACK POSITION CORRECTION MACHINE

The present invention relates to improvements in a mobile track tamping and track position correction machine which comprises a machine frame, undercarriages mounting the machine frame for mobility on a track consisting of a multiplicity of ties fastened to two rails, a tamping head and track position correction means mounted on the machine frame. The tamping head includes a tamping tool carrier vertically movably mounted in the machine frame and supporting tamping tools capable of tamping ballast under respective ones of the ties upon downward movement of the tamping tool carrier and immersion of the tamping tools in the ballast adjacent the respective ties, and drive means for vibrating reciprocating the tamping tools in the direction of track elongation. The track position correction means comprises means for lifting the track for leveling the same and, if desired, for laterally moving the track for lining the same.

Such track surfacing machines are very well known, as exemplified by U.S. Pat. No. 3,000,328, dated Sept. 19, 1961. They have frames which carry the tamping heads and all other parts required for desired track surfacing operations, the frames being frameworks extending to or over the undercarriages which support them on the track, i.e. at least over the width of the track, and supporting the tamping heads within their boundaries. In one type of these known machines, the tamping heads and the track correction means are supported on a portion of the frame overhanging the front undercarriage while the tamping heads and track correction means are supported on the frame between the front and rear undercarriages in another type of track surfacing machines. Machines of both types have been very successfully used in automatic track surfacing for many years but their frames are relatively complicated structures requiring a lot of space and access to the tamping heads and other operating parts mounted within the boundaries of the frameworks is difficult, thus making repairs quite cumbersome.

U.S. Pat. No. 3,425,360, dated Feb. 4, 1969, discloses a track tamping, leveling and lining machine wherein only the tamping heads are mounted on a framework of the above-described configuration while the track position correction means is mounted on an elongated carrier beam extending in the direction of track elongation and coupled to the front of the machine framework. This arrangement provides improved access at least to some of the operating parts, i.e. the track lifting and lining unit. This construction is expensive and is economically feasible only in very high-quality tampers designed for special surfacing work. It is uneconomical for the ordinary track surfacing machine.

It is the primary object of this invention to provide an improved mobile track tamping and track position correction machine of the first-indicated kind which is simple in structure and affords relatively easy access to the tools and drives on the tamping heads, thus enabling repairs to be made readily even on the work site and during the surfacing operation, with a minimum of interruptions. This is becoming an ever more important requirement because of increasing train speeds and frequencies, which provide correspondingly decreasing intervals for the track surfacing operations carried out between passing trains.

The above and other objects are accomplished in accordance with the invention in a surprisingly simple manner by the use of a machine frame consisting of an elongated carrier beam centered between the two rails and mounting the tamping head or heads on the carrier beam laterally of the center beam and astride a respective one of the rails.

This strikingly simple arrangement provides a machine operator a perfect overview in all types of mobile tampers, including switch tampers, and greatly facilitates access to the tamping heads and their operating parts, thus making it possible to service the tamping heads very easily and even on the working site, including making repairs on the hydraulic and/or electrical systems used in the operation of the tamping and/or track correction tools. All the operating parts of the machine mounted on such a center beam are so clearly visible and readily accessible that the operation as well as repairs of the machine are much improved and expedited. Furthermore, the symmetric position of the elongated carrier beam provides a central absorption and distribution of all operating forces so that the strength of the beam may be suitably selected according to peak loads expected in various types of such machines, such peak loads being relatively low due to the distribution of the load over the elongated center beam. Finally, the center beam frame has a width much less than the distance between the track rails so as to leave considerable free spaces between the rails and the beam, which is of particular advantage in underground tracks.

The above and other objects, advantages and features of the present invention will become more apparent from the following description of two now preferred embodiments thereof, taken in conjunction with the accompanying schematic drawing wherein.

Figure 1:
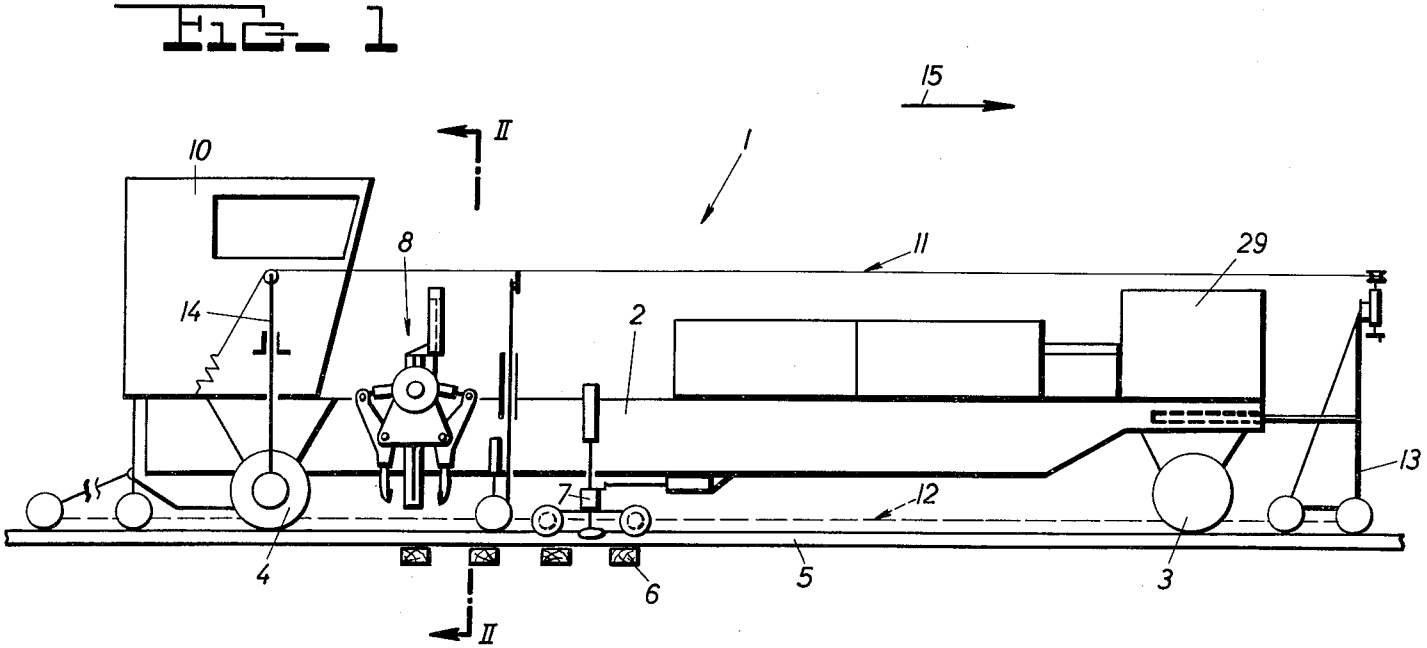
FIG. 1 is a side elevational view of one embodiment of a track tamping and track position correction machine according to this invention, with the entire center carrier beam extending substantially parallel to the track.

FIG. 5 is a partial side elevational view, partly in longitudinal section, of another embodiment wherein the center beam has a first portion extending substantially parallel to the track and a second, higher portion rising therefrom, only the latter portion and the parts carried thereby being shown in this partial view; and FIG. 6 is an end view of the two transversely aligned tamping heads and their mounting of a modification of the embodiment of FIG. 5.

Referring now to the drawing and first to FIGS. 1 to 4, mobile tamping and leveling machine 1 illustrated therein is particularly useful in straight track surfacing work and constitutes the simplest form of the machine still obtaining the advantages of this invention. This machine comprises a front undercarriage 3 and a rear undercarriage 4 mounting elongated carrier beam 2 for mobility on a track consisting of a multiplicity of ties 6 fastened to two rails 5. The carrier beam extends substantially parallel to the track and has side walls 25, 26 facing a respective one of the rails, tamping heads 8 and 9 being mounted in transverse alignment laterally of a respective one of the carrier beam side walls.

Throughout the specification and claims, the terms "front" and "rear" refer to the operating direction of the mobile machine, indicated by arrow 15 in FIG. 1.

Track correction position means 7 is mounted on carrier beam 2, illustrated means 7 consisting of a conventional track lifting and lining unit including pairs of rollers arranged to grip each rail and hydraulic jacks mounted to lift the rollers and move them laterally for leveling and lining the track gripped by the rollers. In the illustrated embodiment, the tamping heads are mounted closer to rear undercarriage 4 than front undercarriage 3 and the track correction unit 7 is mounted between the tamping heads and the front undercarriage. A generally conventional reference system for controlling the leveling of the track by unit 7 includes reference 11. The illustrated undercarriages have a single axle and reference line 11 has an end point in substantially vertical alignment with the axle of the rear undercarriage. An also generally conventional reference system for controlling the lining of the track by unit 7 includes reference line 12, the front end points of the reference lines being positioned on front bogie 13 which is coupled to center beam 2 and movable along the track therewith. Track surfacing reference systems of the schematically shown type are well known and include, as illustrated, control means with track sensing means mounted on a measuring bogie 14 positioned rearwardly adjacent the tamping heads. The end point of lining reference line 12 is positioned on a rear bogie coupled to the center beam and movable along the track therewith, suitable control means including track sensing means also being provided in a known and sketchily illustrated manner for the lining reference. The illustrated machine rests with its rear portion on a corrected track section and moves forwardly in the direction of arrow 15 during the leveling operation. Operator's cabin 10 is mounted on the carrier beam in the region of rear undercarriage 4, which permits a perfect overview over the working parts of the machine during the tamping and track leveling and/or lining operation. This provides a very simple and useful machine arrangement making use of available reference systems and other machine parts.

Figure 2:
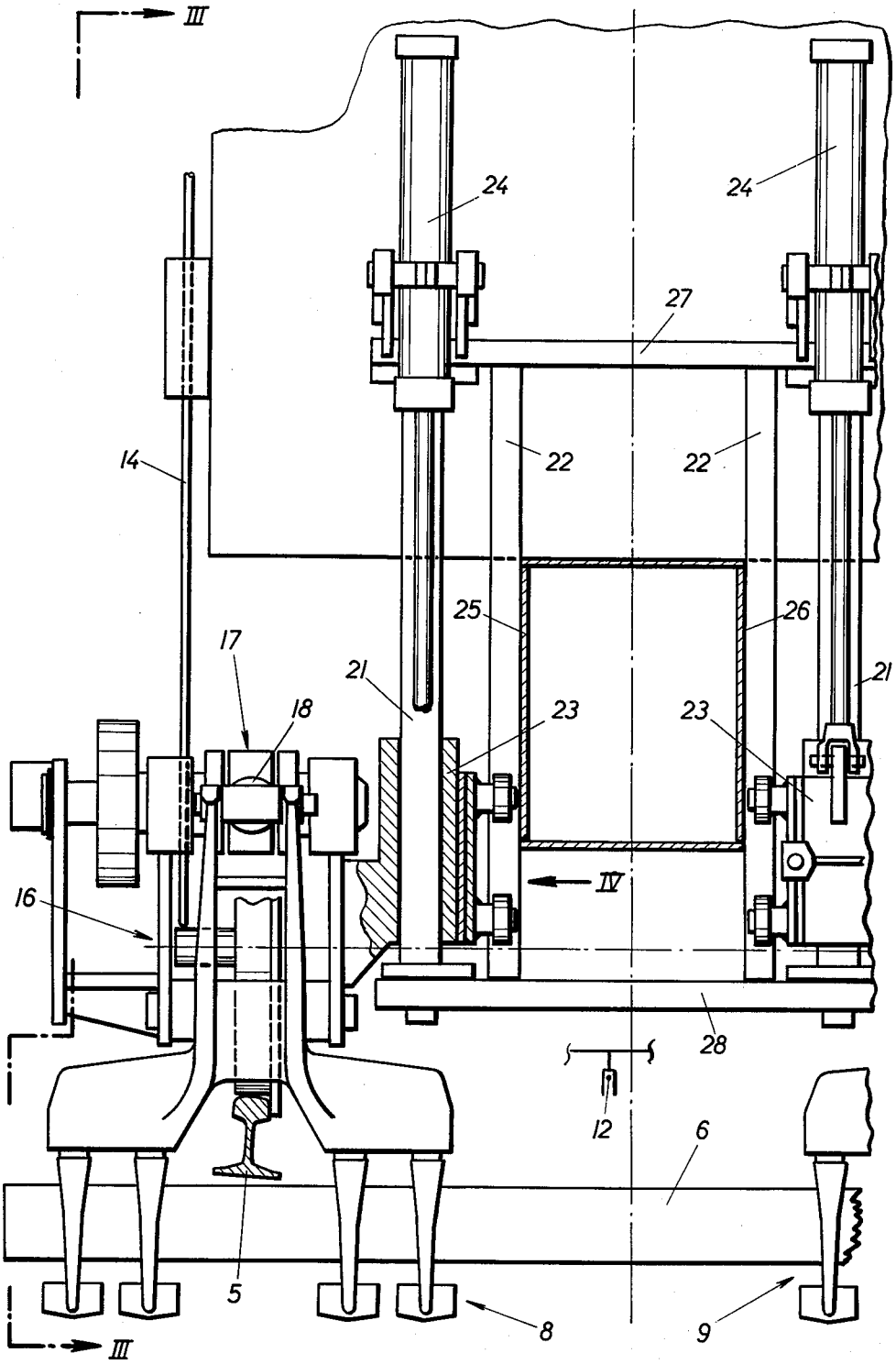
FIG. 2 is an enlarged transverse section along line II—II of FIG. 1, only one tamping head arrangement being shown in full, the symmetrically arranged other tamping head arrangement being only partially illustrated.

As shown in the section of FIG. 2, elongated carrier beam 2 is a hollow shape of rectangular cross section bounded by two side walls 25, 26 interconnected by two horizontal end walls. Two tamping heads 8 and 9 are mounted in transverse alignment laterally of the side walls and vertical guide means to be described in detail thereafter slidably supports each tamping head carrier. Each vertical guide means is arranged between one side wall and an associated tamping head for verticaly guiding the tamping heads eccentrically, viewed in the direction of track elongation, and symmetrically, viewed in a direction transverse to the track elongation. The width of the carrier beam between side walls 25, 26 is selected so as to permit vertical guidance and movement of the tamping head left and right of the carrier beam outside the side walls, and the tamping heads are centered over the respective rails 5. This provides a compact, perfectly balanced construction which is very sturdy and capable of sustaining and uniformly distributing considerable loads to which the machine may be subject during operation. Furthermore, the hollow center beam may house various operating parts in openings and/or recesses, carrying electrical and/or hydraulic lines in its hollow interior, if desired. The centered and symmetrical guidance of the tamping heads outside the cross section of the center beam makes it possible to mount drives 24, 24 for vertically moving the tamping heads directly thereabove and extending substantially parallel to the vertical guide means for the tamping heads for independently and effectively moving each tamping head for proper immersion of the tamping tools in the ballast, the strong linear downward thrust facilitating the penetration of the tools into the ballast.

Figures 3, 4:
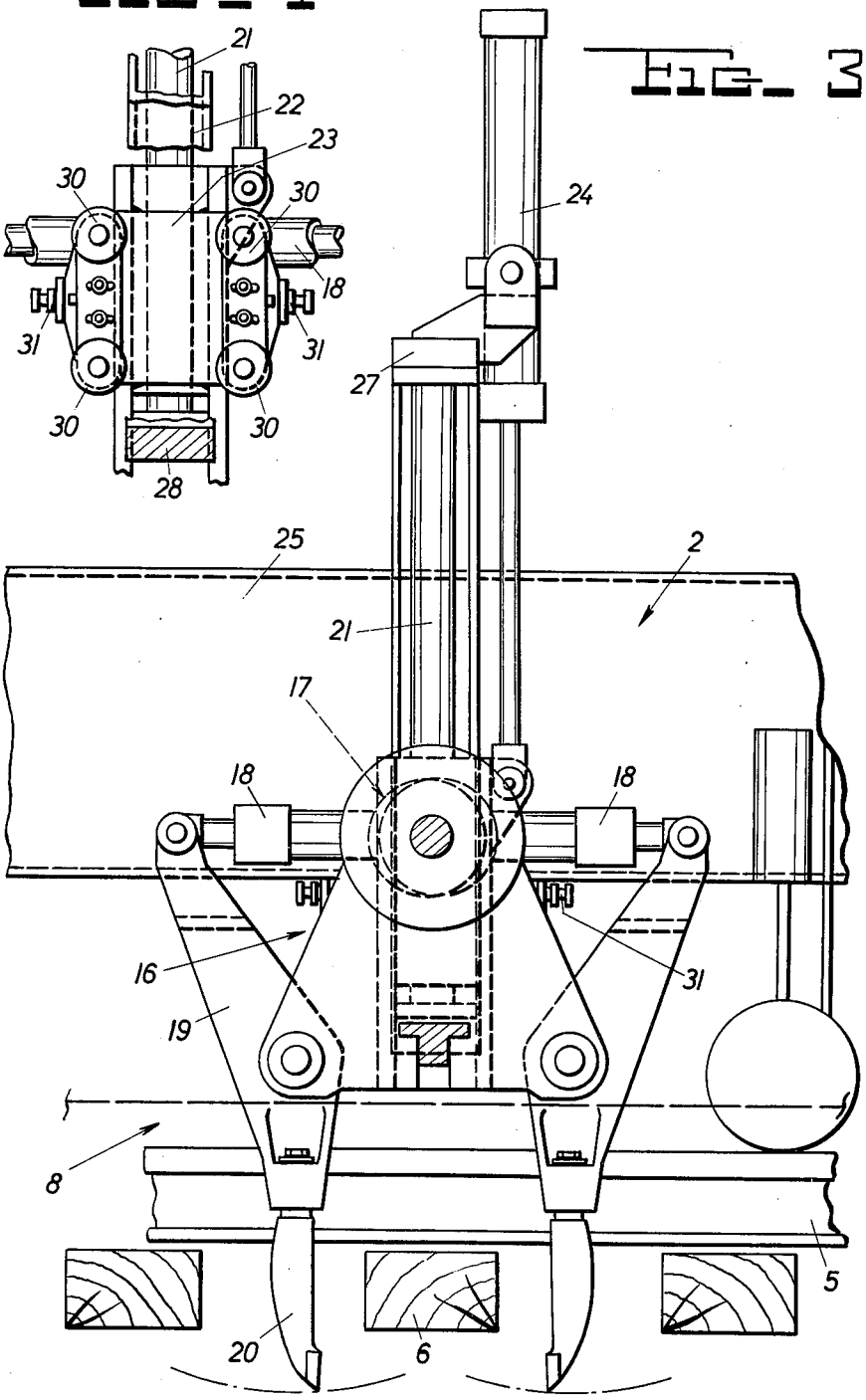
FIG. 3 is a section along line III—III of FIG. 2, FIGS. 2 and 3 clearly showing the mounting of the tamping heads laterally of the elongated center carrier beam.
FIG. 4 is an end view in the direction of arrow IV of FIG. 2 and illustrating a detail of the vertical guide for the tamping head carrier.

As shown in FIGS. 2 and 3, each tamping head 8, 9 is of the type more fully described and claimed in my U.S. patent application Ser. No. 695,732, filed June 14, 1976 and entitled "Mobile Track Tamper." It includes tamping tool carrier 16 which comprises a pair of laterally spaced vertical support webs which pivotally support a pair of tamping tool implements arranged to be reciprocated towards and away from each other for tamping ballast under respective ties 6. Drive means 17 and 18 for vibrating and reciprocating the tamping tools in the direction of track elongation are mounted on the carrier support webs. Each tamping tool implement consists essentially of a rigid unit comprised of tamping tool holder 19 and tamping tools 20 detachably mounted on horizontally extending side arms of the holder, all in a manner fully disclosed and claimed in the above-identified patent application. As described in the copending application, this type of tamping head is particularly useful but the present invention is not limited thereto and may use any conventional tamping head which may be mounted on a central carrier beam serving as the machine frame.

As indicated hereinabove, a vertical guide means for each tamping head is mounted on carrier beam 2 between each side wall 25, 26 and tamping head. In the illustrated embodiment, each vertical guide means includes vertical guide column 21 vertically slidably supporting the tamping head carrier by means of sliding head 23 and vertical guide track 22 adjacent side walls 25, 26 of center beam 2. Guide means 30 guidingly interengage the guide column and guide track for guiding the tamping head carrier along the column. As will be appreciated from the combined consideration of FIGS. 2 to 4, sliding head 23 is affixed to the tamping head carrier and has a vertical bore slidingly engaging vertical column 21 while guide track 22 extends parallel thereto and is affixed to a side wall of the center beam. Transverse struts 27, 28 are affixed to the ends of guide tracks 22, 22 and extend parallel to the ends walls of the center beam and project beyond the side wall thereof to support guide columns 21, 21. Hydraulic jacks 24, 24 extend parallel to the vertical guide means 21, 22 and have their piston rods linked to the tamping head carriers for vertically moving the tamping heads. The illustrated guide columns 21 are cylindrical and the guide tracks 22 are substantially U-shaped profiles, FIG. 4 showing sliding head 23 mounting pairs of rollers 30 for guidingly engaging the guide track. Set screws 31 enable the roller distances to be adjusted for engaging the track without play.

The illustrated arrangement of the tamping heads and their vertical guide means provides a very simple and effective structure for mounting the tamping heads left and right of center beam 2, the guide means being asymmetrically arranged, i.e. on one side of the tamping heads to make access to the tamping tool implements and drives readily available for servicing the tamping heads. The symmetrical arrangement of the two transversely aligned tamping heads has the advantage of reducing torsional and tilting forces on the center beam so that the wear on the machine frame is greatly minimized. The width of the center beam is so dimensioned that it does not exceed the minimum distance between the left and right tamping head, thus avoiding possible collisions during the vertical movement of the tamping heads. On the other hand, the center beam width is substantially the maximum permitting vertical guidance and movement of the tamping heads left and right of the carrier beam outside the side walls of the beam, i.e. its width is selected in accordance with the minimum distance between the tamping heads, so that it has sufficient strength to absorb the forces to which a tamping machine frame is normally subjected. In other words, the dimensions of elongated carrier beam 2 considerably exceed those of the struts, trusses and beams used in conventional frameworks constituting the frames for tamping machines.

As shown in FIG. 1, the central carrier beam has substantially the same cross section along its entire length although, as far as the present invention is concerned, only its portion between the two undercarriages is of significance since this is the portion serving as the carrier frame for the operating parts, i.e. the tamping heads and the track correction unit. The end portions of the beam may be expanded or modified in cross section for attachment of the undercarriages, support of machine drive means 29, which may include a hydraulic fluid tank, various controls and any additional tools, as may be desired.

Either modification of the embodiment of FIGS. 5 and 6 is particularly useful for a switch tamper 32 wherein it is desired to mount the tamping heads transversely movable with respect to the track so that the tamping tools may be properly positioned in relation to a track switch, as is well known per se. In this embodiment, elongated carrier beam 33 has a first portion 33*a* extending in a horizontal plane parallel to the track and second portion 35 between the first portion and rear undercarriage 34. The second carrier beam portion rises from the first portion above the horizontal plane and constitutes a portion of carrier beam 33 higher than the first portion. The higher carrier beam portion is more or less U-shaped and defines open working zone 36 between higher carrier beam portion 35 and the track. A pair of transversely aligned tamping heads 38, 39 are mounted on the higher carrier beam portion within working zone 36 movably transversely of the track along crossbeam 37. As in the first described embodiment, track lining and leveling unit 40 is mounted on the center beam forwardly of the tamping heads, as are the track sensors 41 forming part of the leveling and lining reference system. In the illustrated embodiment, unit 40 is also mounted on higher carrier beam portion 35.

Even with the shaping of the center beam rear portion to accommodate the transverse movement of the tamping heads, this machine arrangement is still much more economical and simpler than conventional switch tampers because the advantages described in connection with the embodiment of FIGS. 1 to 4 remain fully intact, as far as mounting, accessability and an excellent overview from the operator's cabin are concerned.

In both illustrated modifications of this embodiment each tamping head 38, 39 is centered above a respective track rail and has a carrier 42 with sliding head 44 guided along vertical guide 43, the jacks for moving the tamping heads along their vertical guide means not being shown in this figure. In the modification shown in FIG. 6, the higher carrier beam portion 35 extends centrally of the rails in line with the first carrier beam portion 33*a* and carries two like carrier arms 48*a* symmetrically extending from the higher carrier beam portion towards the rails. Obviously and equivalently, as shown in FIG. 6, the higher carrier beam portion may be forked to provide the two carrier arms, such a forked carrier beam portion including two like beam parts symmetrically diverging from first carrier beam portion 33*a* towards the rails, each such beam part consisting of a first section 35*a* rising from the first carrier beam portion, a second section 35*b* supported on rear undercarriage 34 and intermediate section 35*c* interconnecting sections 35*a* and 35*b*. In this modification support brackets 48, 48 depend from intermediate beam sections 35*c* of each diverging beam part to support crossbeam 37 therebetween. In either case, tamping heads 38, 38 are transversely movably mounted on the intermediate beam part section, the mounting illustrated in the drawing comprising crossbeam 37 mounted on side arms 48, 18 in working zone 36. Vertical guides 43, 43 have bearing glidably supporting the guides on crossbeam 37 and hydraulic jacks 45, 45 are connected to each guide bearing to enable each tamping head to be moved independently in a direction transverse to the track. A guide arm 46 with roller 47 guides the tamping head along carrier beam 33 during its transverse movement.

It will be understood that many variations and modifications may occur to those skilled in the art, particularly after benefitting from the present teaching, and this invention is not limited to the specifically illustrated and described embodiments. For instance, a great variety of tamping heads and tamping tool arrangements may be advantageously mounted on a central carrier beam, including surface tampers. The carrier beam may have various cross sections suitable to provide maximum support and minimum space, including I-beams or II-shaped beams, the resultant side wall recesses in such beams serving to accommodate various additional tools and/or electric and/or hydraulic lines. If the rear portion of the center beam is fork-shaped, the tamping tools and possibly the track correction unit may be mounted between the two beam parts forming the fork, in addition to the operator's cabin which may be suspended on the fork to make observation of the tamping, leveling and lining operation thereunder particularly good.

What is claimed is:

1. A mobile track tamping and track position correction machine which comprises a machine frame, undercarriages mounting the machine frame for mobility on a track consisting of a multiplicity of ties fastened to two rails, a tamping head mounted on the machine frame, the tamping head including a tamping tool carrier vertically movably mounted on the machine frame and supporting tamping tools capable of tamping ballast under respective ones of the ties upon downward movement of the tamping tool carrier and immersion of the tamping tools in the ballast adjacent the respective ties, and drive means for vibrating and reciprocating the tamping tools in the direction of track elongation, and track position correction means mounted on the machine frame, wherein the machine frame consists of an elongated carrier beam centered between the two rails and the tamping head is mounted on the carrier beam laterally thereof and astride a respective one of the rails.

2. The mobile track tamping and track position correction machine of claim 1, wherein the tamping head carrier supports a pair of said tamping tools arranged to be reciprocated towards and away from each other for tamping ballast under respective ties.

3. The mobile track tamping and track position correction machine of claim 1, wherein the track position correction means comprises means for lifting the track for leveling the same.

4. The mobile track tamping and track position correction machine of claim 3, wherein the track position correction means comprises means for laterally moving the track for lining the same.

5. The mobile track tamping and track position correction machine of claim 1, comprising two of said undercarriages mounting the elongated carrier beam for mobility on the track, at least the portion of the carrier beam extending between the two undercarriages extending substantially parallel to the track and said carrier beam portion having side walls facing a respective one of the rails, the tamping head being mounted laterally of a respective one of the carrier beam side walls.

6. The mobile track tamping and track position correction machine of claim 1, comprising a rear and a front one of said undercarriages mounting the elongated carrier beam for mobility on the track, the carrier beam between the undercarriages including a first portion extending in a horizontal plane substantially parallel to the track and a second portion between the first portion and the rear undercarriage, the second carrier beam portion rising from the first portion above the horizontal plane and constituting a portion of the carrier beam higher than the first portion thereof, the higher carrier beam portion defining an open working zone between the higher carrier beam portion and the track, and the tamping head being mounted on the higher carrier beam portion within the working zone movably transversely of the track.

7. The mobile track tamping and track position correction machine of claim 6, wherein the track position correction means is mounted on the higher carrier beam portion.

8. The mobile track tamping and track position correction machine of claim 6, wherein the higher carrier beam portion is forked and includes two like beam parts symmetrically diverging from the first carrier beam portion towards the rails, each beam part consisting of a first section rising from the first carrier beam portion, a second section supported on the rear undercarriage and an intermediate section interconnecting the first and second beam part sections, the tamping head being mounted transversely movably on the intermediate beam part sections.

9. The mobile track tamping and track position correction machine of claim 6, wherein the higher carrier beam portion extends centrally of the rails in line with the first carrier beam portion and carries two like carrier arms symmetrically extending from the higher carrier beam portion towards the rails, the tamping head being mounted transversely movably on the two carrier arms.

10. The mobile track tamping and track position correction machine of claim 1, comprising two of said tamping heads mounted in transverse alignment laterally of respective side walls of the carrier beam, and a vertical guide means for each of the tamping heads mounted on the carrier beam between each side wall and tamping head, each vertical guide means including a vertical guide column vertically slidably supporting the tamping head carrier, a vertical guide track associated with the guide column, and means guidingly interengaging the guide column and track for guiding the tamping head carrier along the column.

11. The mobile track tamping and track position correction machine of claim 1, comprising two of said tamping heads mounted in transverse alignment laterally of respective side walls of the central carrier beam, the width of the carrier beam between the side walls being substantially the maximum permitting vertical guidance and movement of the tamping heads left and right of the carrier beam outside the side walls.

12. The mobile track tamping and track position correction machine of claim 1, comprising two of said tamping heads mounted in transverse alignment laterally of respective side walls of the central carrier beam, the carrier of each tamping head being substantially centered above a respective one of the rails, and vertical guide means slidably supporting each tamping head carrier.

13. The mobile track tamping and track position correction machine of claim 12, further comprising means for transversely moving the vertical guide means on the central carrier beam.

14. The mobile track tamping and track position correction machine of claim 12, comprising a rear and front one of said undercarriages mounting the elongated carrier beam for mobility on the track, the vertical guide means and tamping heads supported thereon being positioned on the carrier beam between the undercarriages, and the track position correction means comprising means for lifting the track for leveling the same and being positioned between the vertical guide means and the front undercarriage.

15. The mobile track tamping and track position correction machine of claim 14, wherein the vertical guide means and tamping heads are positioned closer to the rear than to the front undercarriage.

16. The mobile track tamping and track position correction machine of claim 15, further comprising a reference system for controlling the leveling of the track by the track lifting means, and control means including track level sensing means.

17. The mobile track tamping and track position correction machine of claim 12, further comprising a drive connected to each of the vertical guide means and extending substantially parallel thereto for vertically moving each tamping head carrier independently.

18. The mobile track tamping and track position correction machine of claim 1, comprising a single-axle rear and front one of said undercarriages mounting the elongated carrier beam for mobility on the track, and further comprising an operator's cabin mounted on the carrier beam in the region of the rear undercarriage, and a reference system for controlling the leveling of the track by the track position correction means, the reference system including a reference line having an end point in substantially vertical alignment with the axle of the rear undercarriage.

19. The mobile track tamping and track position correction machine of claim 1, wherein the elongated carrier beam is a hollow shape of substantially rectangular transverse cross section bounded by two side walls interconnected by two end walls.

20. The mobile track tamping and track position correction machine of claim 19, comprising two of said tamping heads mounted in transverse alignment laterally of a respective one of the carrier beam side walls, and vertical guide means slidably supporting each tamping head carrier, each guide means being arranged between one of the side walls and one of the tamping heads for vertically guiding the tamping heads eccentrically viewed in the direction of track elongation and symmetrically viewed in a direction transverse to the track elongation.

* * * * *